United States Patent [19]

Ragusa

[11] 4,096,969

[45] Jun. 27, 1978

[54] CIGARETTE DISPENSER ADAPTER

[76] Inventor: Anthony Ragusa, 4916 Rye St., Metairie, La. 70002

[21] Appl. No.: 794,931

[22] Filed: May 9, 1977

[51] Int. Cl.[2] ..... B65H 31/20

[52] U.S. Cl. ..... 221/199; 221/242

[58] Field of Search ..... 221/197, 199, 312, 241, 221/242, 287, 282

[56] References Cited

U.S. PATENT DOCUMENTS

| | | | |
|---|---|---|---|
| 3,333,732 | 8/1967 | Schendorf et al. | 221/242 |
| 3,360,091 | 12/1967 | Baum | 221/242 X |
| 3,871,059 | 3/1975 | Goldenstein | 221/242 |

*Primary Examiner*—Allen N. Knowles

*Attorney, Agent, or Firm*—David L. Ray; Edgar E. Spielman, Jr.

[57] ABSTRACT

An apparatus for adapting a conventional, mechanical cigarette vending machine to dispense cigarette packages of increased length. The apparatus is an elongated, substantially rectangular sleeve for holding a series of longer cigarette packs in a vertically stacked position. The sleeve is suspended in the space left between two adjacent dividers of a conventional cigarette machine magazine after removing the divider therebetween. Two lips are provided at the top of the apparatus and one toward the bottom of the apparatus to support the apparatus between the two adjacent dividers and to connect the apparatus to the rear of the machine.

10 Claims, 12 Drawing Figures

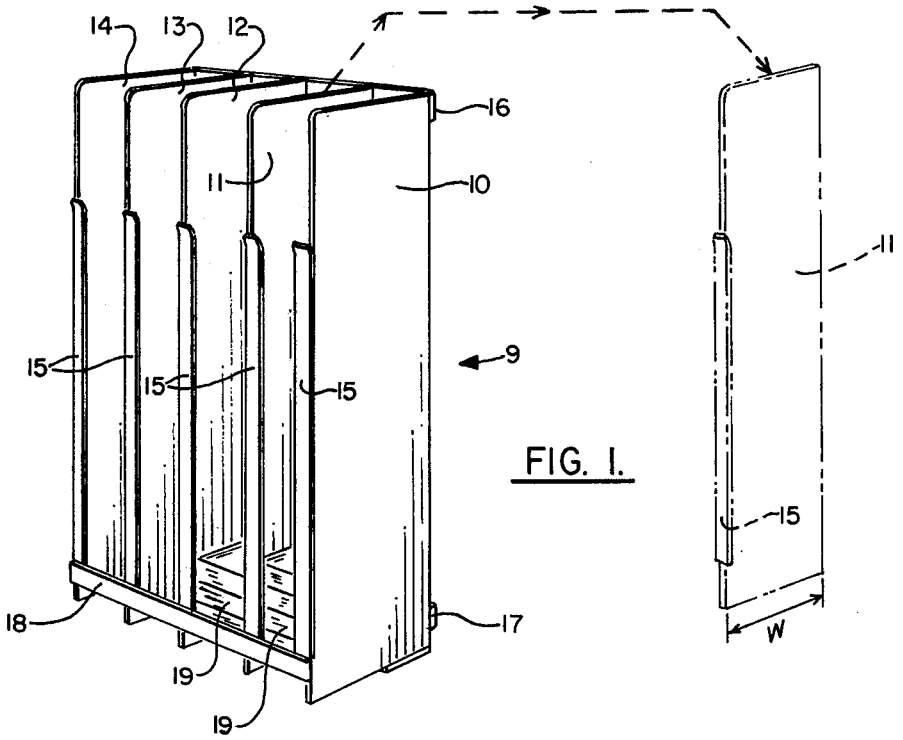
FIG. 1.
FIG. 2.
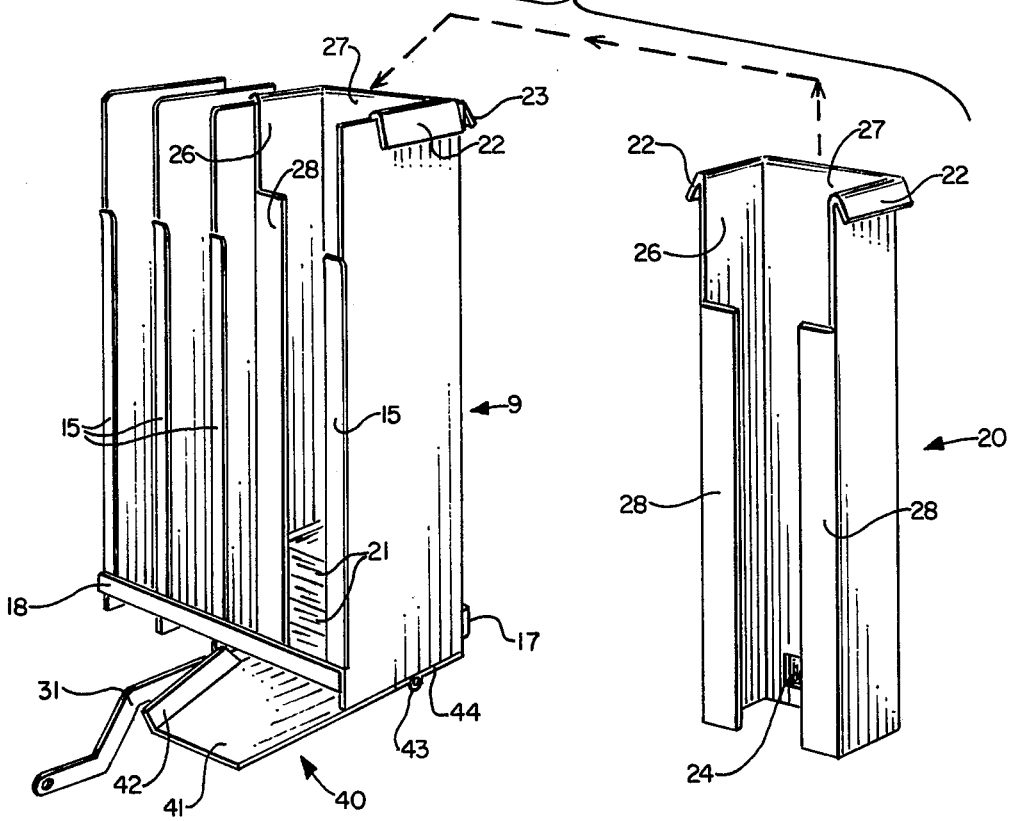

CIGARETTE DISPENSER ADAPTER

BACKGROUND OF THE INVENTION

Existing cigarette vending machines are commonly incapable of handling "king" size or cigarettes up to 120 millimeters in length. The older machines have heretofore been limited to the regular pack size or have had to be converted at considerable expense to accommodate the longer cigarette packs.

U.S. Pat. No. 3,601,237 discloses a conversion kit which can be added to a conventional cigarette dispenser to adapt the dispenser to handle the larger cigarettes. However, the conversion kit of U.S. Pat. No. 3,601,237 is a larger magazine constructed to replace a smaller vending machine magazine which must be removed from the existing unit.

SUMMARY OF THE INVENTION

In accordance with the foregoing invention, an apparatus is provided for adapting a conventional, mechanical cigarette vending machine for vending cigarette packages of shorter length to dispense cigarette packages of greater length. The apparatus is an elongated, substantially rectangular sleeve for holding a series of longer cigarette packages in a vertically stacked, face down position. The apparatus is suspended between two dividers of a conventional, mechanical cigarette machine magazine after removing one divider. Two lips are provided at the top of the apparatus to position the apparatus between two adjacent dividers of the magazine.

BRIEF DESCRIPTION OF THE DRAWINGS

FIG. 1 is a front perspective view of a cigarette magazine for use in a cigarette vending machine with one panel shown being removed.

FIG. 2 is a front perspective view of a cigarette magazine with the adapter of the present invention placed therein.

DESCRIPTION OF THE PREFERRED EMBODIMENTS

Figure 3:
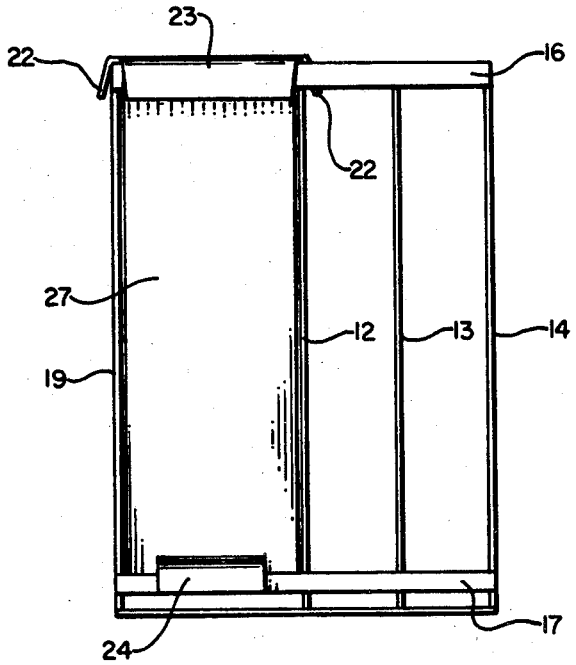
FIG. 3 is a back view of a cigarette magazine having the adapter of the present invention connected thereto.

Referring now to the drawings, in FIG. 1 is shown a conventional, mechanical cigarette magazine generally indicated by the numeral 9. Mechanical cigarette machines are herein defined as those having no electrically operated members. Magazine 9 is composed of a series of vertical dividers, 10–14, which form a series of channels into which are fitted conventional cigarette packs 19 with their short ends facing the front of the machine. A conventional magazine 9 is constructed such that the width W of each of the dividers 10–14 is approximately the same length as the length of the conventional shorter cigarette pack. Thus, a longer cigarette package such as those up to 120 millimeters will not fit between the dividers.

Stops 15 are provided across the front portions of dividers 10 through 14 of magazine 9 to prevent the cigarette packs from sliding forward. An upper brace 16 and two lower braces 17 and 18 are provided across the dividers 10–14 to hold them rigidly in place. Conventional means (not shown in FIG. 1) can be provided for sliding and dispensing cigarettes from magazine 9.

Figure 4:
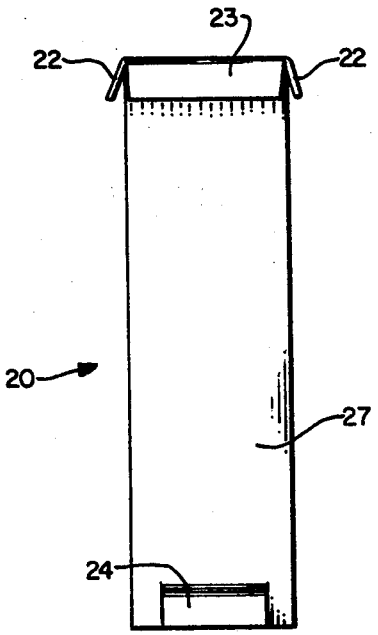
FIG. 4 is a back view of the adapter of the present invention.

As shown in FIG. 1, the first step in converting a conventional magazine to accept the adapter of the present invention is to remove a panel such as divider 11. The magazine 9 is now ready to accept the adapter shown in FIGS. 2 and 4, generally indicated by the numeral 20.

The adapter comprises an elongated, generally rectangular chute or sleeve having dimensions such that the pack of longer cigarettes 21 will fit sideways (the long side facing the front of the machine) snugly and slidably therein. The adapter 20 is preferably formed from a single continuous piece of metal such as aluminum or steel. Adapter 20 has sidewalls 26 connected to back wall 27. Sidewalls 26 have upper lips 22 thereon for engaging the top of divider 10 and divider 12 as indicated in FIGS. 2 and 3. Two vertical front panels 28 extend along the front part of adapter 20 to contain the longer cigarettes 21 within the adapter.

Figure 10:
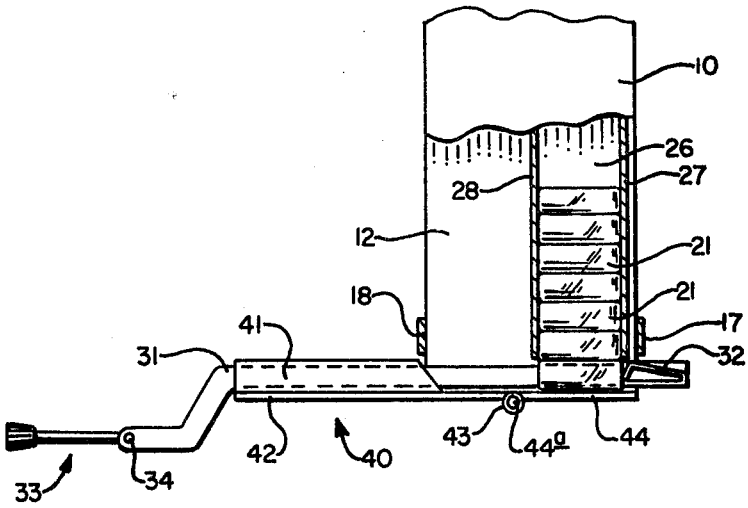
FIG. 10 is a partly cut away side elevational view of the apparatus of the present invention wherein a cigarette package is in position to be ejected.

At the bottom of magazine 9 is a base plate 44 which spans the distance between panels 10 and 12 to provide a surface upon which the vertically stacked cigarette packs 21 can rest as shown in FIGS. 2 and 10–12. Base plate 44 is securely affixed to dividers 10 and 12 by welding or any other suitable means. Base plate 44 has a pivot pin **44*a* or any other conventional pivot means connected thereto. Pivot pin 44*a* fits inside pivot ring 43 of the flap indicated generally by the numeral 40 as shown in FIGS. 2 and 8–12. Flap 40 has pivot ring 43 which fits over pin 44*a* so that flap 40 pivots about pin 44*a*. Any conventional hinge or pivot means may be used to join base plate 44 to flap 40 so that flap 40 rotates relative to plate 44. Flap 40 is spring loaded to maintain the horizontal position as shown in FIG. 10 by any conventional spring means (not shown). The spring means may be either contained internally in pin 44*a* or could be wrapped externally about pin 44*a***.

Figure 8:
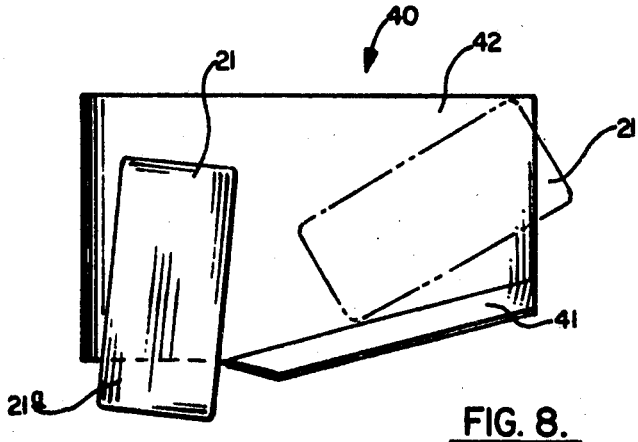
FIG. 8 is the top view of the cigarette dispensing flap of the present invention.
Figure 9:
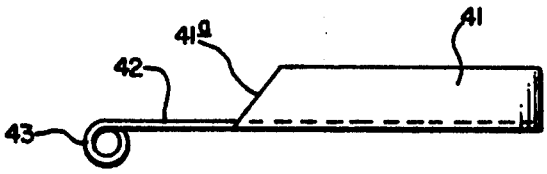
FIG. 9 is a partly sectional top view of the cigarette dispensing flap of the present invention.
Figure 11:
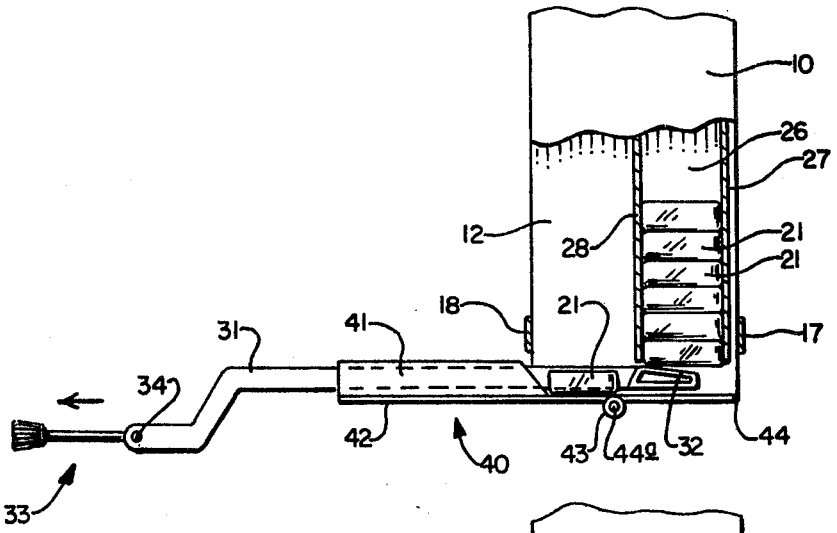
FIG. 11 is a side partly cut away elevational view of the apparatus of this invention wherein a cigarette package is being positioned over the cigarette ejecting flap.
Figure 12:
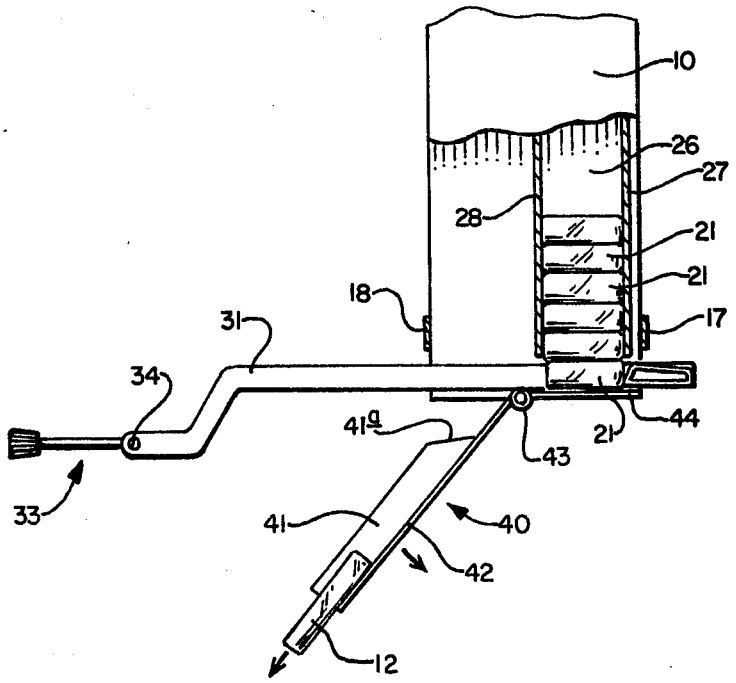
FIG. 12 is a side partly cut away elevational view of the apparatus of the present invention wherein the cigarette package is being ejected from the cigarette ejecting flap.

As can be seen in more detail in FIGS. 8 and 11, flap 40 has a flat bottom 42 upon which a cigatette pack may rest. A sloping sidewall 42 extends upwardly from the bottom 42 of flap 40. Sidewall 41 has a bevelled edge **41*a*. The purpose of the sidewall 41 is to turn the cigarette package 21 from the position shown in the cigarette package which is dark-lined in FIG. 8 to the position of the cigarette package 21** which is dotted in or "ghosted" in in FIG. 8. The cigarette package starts to turn when the edge 21*a* of the package strikes bevelled edge 41*a*. It is necessary that the cigarette package be turned in order that it can easily be dropped through the conventional mechanism which exists below the magazine of most conventional mechanical cigarette machines. The turning of the cigarette package by flap 40 is also shown in FIGS. 11 and 12.

Figure 6:
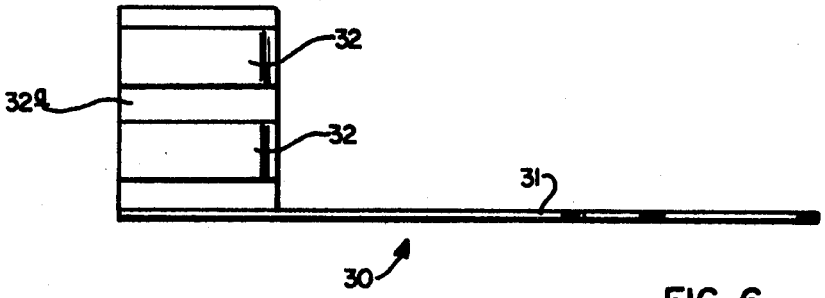
FIG. 6 is a top view of the slide mechanism of the present invention.
Figure 7:
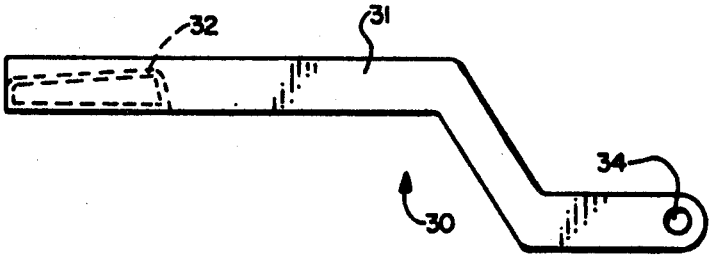
FIG. 7 is a partly sectional side view of the slide of the present invention.

To slide the cigarettes onto flap 40 a slide, generally indicated by the numeral 30, is shown in FIGS. 6 and 7. Slide 30 has an arm 31 which extends longitudinally into the machine and has rigidly connected thereto a plate 32*a*. Plate 32*a* has one or more ejectors 32 attached thereto which strike the cigarette package on the long edge of the package when arm 31 is pulled outwardly as indicated in FIG. 11. The ejectors force the cigarette package 21 onto flap 40, and as arm 31 continues outwardly, it forces flap 40 downwardly when plate 32*a* strikes sidewall 41 of flap 40. Sidewall 41 preferably has a bevelled edge 41*a* which permits flap 40 to be forced downwardly when struck by plate 32*a*. After the cigarette package is ejected, arm 31 is forced inwardly which allows flap 40 to return upwardly under spring pressure. Arm 31 may have a knob, generally indicated by the numeral 33 in FIGS. 10–12, attached to hole 34 in arm 31 to facilitate sliding arm 31 backward and forward in a horizontal direction.

If desired, the adapter may be provided with an upper back lip 23 which may engage a support bar such as 16 which may be provided at the back of the cigarette dispenser. At the bottom of panel 27 is located another lip 24 which may be used to engage a lower brace 17 as is shown in FIG. 3. Both lips 23 and 24 may be omitted, although it is preferred that lip 24 and 24*a* be included for greater stability.

Figure 5:
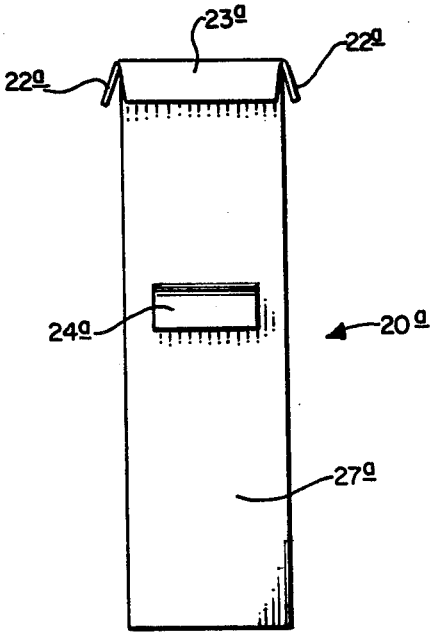
FIG. 5 is a back view of an alternate embodiment of the adapter of the present invention.

In FIG. 5 is shown another embodiment of the adapter 20 generally indicated by the numeral 20*a* which shows the upper lip 24*a* at a higher position along the back of panel 27*a* to engage a brace which might be located at a height above the bottom of panel 27. The remainder of the elements of adapter 20*a* are the same as adapter 20 with the exception that the letter *a* has been added thereto.

Thus it can be seen that the adapter of the present invention can be easily installed in a conventional cigarette vending machine magazine 9 by removing panel 11 or any other similar panel from the conventional magazine and inserting adapter 20 downwardly between the two adjacent dividers 10 and 12 from between which has been removed a divider 11. The lips 22 engage the top of the two adjacent dividers to securely hold the adapter in place. Furthermore, a rear lip 24 may engage a back brace to provide further stability. The longer cigarettes 21 may then be placed in the adapter 20 so that the long edge of the longer cigarettes is facing in the direction that the top end or the bottom end of the shorter cigarettes is facing.

What is claimed is:

1. An apparatus for adapting a conventional mechanical cigarette vending machine having a magazine for dispensing shorter cigarettes to dispense longer cigarettes, said magazine having a series of vertical divider means for holding cigarettes, said apparatus comprising:
   a. a generally elongated, rectangular sleeve means having a flat back means;
   b. two flat, rectangular side panel means extending approximately perpendicularly on the same side of said back panel means and being connected thereto;
   c. lip means connected to the top of said sidewall means for connecting said apparatus to said dividers; and
   d. front panel means connected to and extending from said side panel means to contain said longer cigarettes within said sleeve means.

2. The apparatus of claim 1 wherein said apparatus is formed from a single, continuous piece of metal.

3. The apparatus of claim 1 wherein second lip means is connected to said back panel means to connect said back panel means to said magazine.

4. The apparatus of claim 3 wherein third lip means is connected to said back panel means to connect said back panel means to said magazine.

5. The apparatus of claim 1 wherein said front panel means extend perpendicularly from said side panels toward each other.

6. The apparatus of claim 1 wherein base plate means is connected to said divider means to provide a base for said cigatettes to rest upon.

7. The apparatus of claim 6 wherein slide means extends longitudinally into said magazine and is slidably attached to said magazine for sliding said longer cigarettes from said base plate to flap means, said flap means being pivotally connected to said base means.

8. The apparatus of claim 7 wherein said flap is biased by spring means to maintain a horizontal position when no cigarette package is resting thereon.

9. The apparatus of claim 8 wherein said flap means is adapted to turn said longer cigarette package as the package is dispensed.

10. The apparatus of claim 8 wherein said flap means has a sloping sidewall means which turns said longer cigarette package as the package is dispensed.

* * * * *